US008246049B1

(12) United States Patent
Martens et al.

(10) Patent No.: US 8,246,049 B1
(45) Date of Patent: Aug. 21, 2012

(54) CRIBBAGE CARD GAME AND PEGGING BOARD

(76) Inventors: Philip S. Martens, Minneapolis, MN (US); Alan Oller, Minneapolis, MN (US); Robert Ramola, Minneapolis, MN (US)

( * ) Notice: Subject to any disclaimer, the term of this patent is extended or adjusted under 35 U.S.C. 154(b) by 221 days.

(21) Appl. No.: 12/380,342

(22) Filed: Feb. 26, 2009

Related U.S. Application Data

(60) Provisional application No. 61/002,879, filed on Feb. 26, 2008.

(51) Int. Cl.
*A63F 1/00* (2006.01)

(52) U.S. Cl. ..... 273/292; 273/249; 273/274; 273/306; 463/13

(58) Field of Classification Search ..... 273/292, 273/274, 309, 303–306, 249; 463/13, 12
See application file for complete search history.

(56) References Cited

U.S. PATENT DOCUMENTS

| | | | | |
|---|---|---|---|---|
| 142,791 | A | 11/1945 | Reeves | |
| 4,170,358 | A | 10/1979 | Hancock | |
| 4,598,912 | A | 7/1986 | Kendrick | |
| D311,707 | S | 10/1990 | Clements | |
| 5,028,765 | A | 7/1991 | Hull et al. | |
| 5,280,916 | A | 1/1994 | Gleason | |
| 5,590,883 | A | 1/1997 | Brewer | |
| 5,879,007 | A * | 3/1999 | Kasri | 273/292 |
| 6,257,577 | B1 | 7/2001 | Sutton | |
| 2005/0093229 | A1 * | 5/2005 | Dewayne et al. | 273/146 |
| 2007/0158907 | A1 * | 7/2007 | Weigl | 273/292 |
| 2008/0036149 | A1 * | 2/2008 | Hughes et al. | 273/292 |

OTHER PUBLICATIONS http://www.rubl.com/rules/cribbage-rules.html Rules of Cribbage, May 26, 2009.

* cited by examiner

*Primary Examiner* — Benjamin Layno
(74) *Attorney, Agent, or Firm* — Kinney & Lange, P.A.

(57) ABSTRACT

The present invention is a card and board game either real or simulated foundationally based on standard cribbage rules. It enhances play by adding one or more special cards to a standard 52-card deck. The special cards significantly increase the variety of hands players can get as well as the strategy involved during pegging and counting. The special cards also significantly enhance the point totals attainable during pegging and counting while preserving the integrity of the classic game of cribbage. A special pegging board can accompany the card game. The board embodiments provide different length lanes for cribbage based play corresponding to differing number of players, player combinations playing the game and game lengths.

22 Claims, 4 Drawing Sheets

CRIBBAGE CARD GAME AND PEGGING BOARD

CROSS-REFERENCE TO RELATED APPLICATIONS

This application claims the benefit of provisional patent application Ser. No. 61/002,879, filed 2008 Feb. 26 by the present inventors.

FEDERALLY SPONSORED RESEARCH

Not Applicable

SEQUENCE LISTING OR PROGRAM

Not Applicable

BACKGROUND

1. Field

This application relates to card and board games, specifically to the card and pegging game of cribbage.

2. Prior Art

Playing card games has been a part of human culture for centuries. As with culture games evolve over time. As players play games, they sometimes imagine means to improve a game and the enjoyment of the game. Cribbage evolved in this manner when Sir John Suckling adapted the game of Noddy into what we now know as cribbage back in the 17$^{th}$ century.

Anyone who has played cribbage for a period of time can learn the counting, pegging and card throwing strategy inside and out. That is why over the years players and inventors have tried to make the game more interesting. Innovators have tried to improve the game of cribbage, known and loved across the world, because people enjoy new game experiences. Most commonly inventors have altered the cribbage experience by creating new board shapes and designs.

In particular, people love new games for which they already have a basic understanding. People can quickly learn and potentially master a new method of playing a game while discovering new plays, strategies, points and play possibilities. With the numerous variations to cribbage boards, there have been surprisingly few attempts to improve the game of cribbage by altering or adding to the actual deck of playing cards, or both deck of playing cards and board structure and design in combination. Some players, however, have come up with ways to alter the card game portion. The most common method of altering cribbage card play has been playing cribbage with double denomination decks of cards.

Cribbage is played with 52 cards of four suits: hearts, clubs, diamond, and spades. The game is played with the cards A, 2, 3, 4, 5, 6, 7, 8, 9, 10, J, Q, K, without jokers. Scoring is traditionally recorded on a board with four parallel lines of 30 holes each plus one or two finish holes. Two pegs are used to record the score for each player; the rear peg showing the previous tally, the front peg recording the current score. Players move their pegs up one side of the board and then back down the other. The aim of Cribbage is to be the first to move the pegs all the way up and down a split length board twice. On a continuous lane style board and simulated board, the players typically peg one length of the board. The winner, is the first to score 121 points.

To start a new game or series of games, players cut for the deal and lowest card wins. Players then take turns to deal. The dealer deals six cards each with two players. Both players discard two cards face down into what is called "the crib" hand, holding in their hand the remaining cards they feel will give them the most points. The crib, which is counted last, is an extra hand scored for the dealer. With three players the dealer gives each 5 cards, throws one for the crib and each player discards one to the crib. With four players individually or in teams of two, each player is dealt five cards and discards one to the crib.

Next the dealer asks the player to the right to cut the cards. That player lifts the deck and the dealer picks the top card of the remaining pile while the cutter sets the deck back down. The dealer then places the cut card atop the deck face up. If the cut card is a Jack, the dealer pegs two points. The Jack is the only card, when cut, that gives points to a player in standard cribbage.

The opponent or player to the left of the dealer begins the pegging play by laying one of his four cards in his hand face up and stating its numerical value. All face cards count ten, the ace counts one and other cards are worth their numerical or "pip" value. The dealer or person to the left of that player then lays a card separately stating the combined total of both cards. Play continues like this with each player alternately laying a card on the pile in front of him or her while verbally keeping tally of the current combined point total. However, the total must not go above 31 points.

When a player cannot play a card without putting the total above 31, that player says "go" and, if possible, the remaining player or players must continue to lay down cards until that player or players, too, cannot play without taking the total above 31. When no player can play any card without taking the total above 31, the player who laid the last card pegs 1 point. When a player takes the total to exactly 31, that player pegs 2 points. Then the player to the left of the one to lay the last card starts a new round of play starting from zero. When one or more player's cards are exhausted, the other player or players continue.

During the play, the following events are scored and the appropriate amounts are immediately recorded and pegged on the cribbage board.

Playing a card bringing the total to 15, 2 points are scored.

Playing a card matching the previous card scores 2 points for a pair.

Playing a third matching card scores 6 points, 2 for each pair.

Playing a fourth matching card scores 12 points, 2 for each pair.

Playing a card such that with the two preceding cards creates a consecutive run, 3 points are scored. The cards do not have to be of the same suit, nor played sequentially. When the next player lays a card extending the run to 4 cards that player scores 4 points, five card runs score 5 points and so on. For example, suppose cards with the following face value were laid in the following order: 8, 6, 4, 5, 7. The fourth card would score 3 points; the fifth card would score 5 points. Aces count low so Queen, King, Ace scores no run points in standard cribbage.

Each player then counts the score of the four cards in his hand plus the turned up card. The non-dealer or person who laid the first card during pegging with more than two players counts first followed by the player who laid next and so on with the dealer counting last.

- Fifteen: each card combination that equals fifteen counts for 2 points.
- A pair, three of a kind, and four of a kind: Count 2, 6 or 12 respectively at 2 points per pair.
- A run: A point for each card in a run.
- A flush: Four or five cards of the same suit. A point is scored for each card.

A 4-point flush is counted when all four cards in the hand with matching suit denominations. The turned up card can be counted if it also matches all four cards in the hand giving it a total of 5 flush points. The crib must have all four cards in the hand and the cut card matching suits to collect 5 flush points. There is no 4-point crib flush and flushes do not count in the pegging portion of play.

One for nobs: Holding a jack of the same suit as the cut card gives one point.

The highest possible hand score in standard cribbage is 29 points; three fives and a Jack in the hand with the turned up cut card being another five of the same suit as the held Jack. It is impossible to score a 19-point hand in standard cribbage.

U.S. Pat. No. 4,170,358 to Hancock (1979) discloses a deck of 52 playing cards where forty eight of the cards have split value, and the remaining four cards are one face value. Using this deck with standard cribbage counting rules makes it possible to have five of a kind in a hand. While using these cards however, it is impossible to have a four or five card flush while also holding five of a kind in the same hand. It further describes counting each of two split hands in one hand and adding the totals together for larger point totals. Thus it counts two full hand scores of five cards each, adds them together and calls it a major minor hand score. So with major minor play and two players, the dealer counts four five card hands and the opposing player counts two five card hands for their scores. Using standard cribbage counting rules of counting five cards per hand makes it impossible to score a 19-point hand using this deck. Other than counting and adding up split denominations the cards have no specific rules, characteristics or unique board for enhancing the play of cribbage.

U.S. Pat. No. 5,280,916 to Gleason (1994), discloses a split face deck of 52 playing cards. One half of the card faces are a standard 52-card deck with four suits and the other half of the faces is another standard deck of 52 cards. This creates a single deck of cards that has two complete 52 standard playing card decks each on the faces of the cards. When used for cribbage the game allows for four or five of a kind but with no flush capability. While following standard cribbage counting rules using this deck of cards, it is also impossible to have a hand score totaling 19 points. This card deck adds no special plays, rules or characteristics or unique board to enhance standard cribbage rules and has no similarity to our invention.

U.S. Pat. No. 5,590,883 to Brewer (1997), discloses a specific cribbage game using a standard 52-card deck in conjunction with a separate deck of peg cards, together with a corresponding board. The cribbage card game is played with the standard deck using standard cribbage rules. The board has certain peg holes at intervals marked along the peg lanes such that the player who lands in a corresponding hole draws from the deck of peg cards. The pegging cards "disrupt the normal course of play when a player lands on predetermined pegging locations." One pegging card makes players go backwards. With standard cribbage there is no rule or play causing a player go backwards. The peg cards also disrupt the flow of the game among other ways, by requiring players to switch cards with other players and change the player who collects the crib points. The standard deck used to play and count the hands has no special properties or rule modifications enhancing cribbage. Nor does the board accommodate different peg lane length games and different lengths of play. The game of cribbage naturally has slow and poor hands, where at times a player barely moves along the board. Additional factors to slow cribbage may not be as fun to some players, wherein our embodiments have several means to speed up and enhance the game of cribbage.

U.S. Pub No: US 2005/0093229 A1, discloses adding a series of cards with added jokers, blue colored card suits and null cards to a standard 52-card deck. This ensuing deck is singularly created to alter the play of many card games including hearts, canasta, sheep's head, rummy, spades, aceyduecy, black-jack, poker, draw poker, solitaire and lastly, cribbage. Using this deck according to its rules allows a possible hand of five fives of mixed suits with no flush possibilities. It is not possible to score a 19-point hand as described. As the modified deck relates to cribbage there are optional jokers. When added to the deck, jokers play as nulls. "Jokers have no point values, nor can they be used as any set or sequence. Jokers and nulls can be used defensively, during the play to stop straights, flushes, pairs and three or more of a kind sequences." In this game, the added jokers have no special rules or characteristics for purpose of play except to block points, block pairs, block sequences, lower hand and crib hand point totals. Further, a deck of 84 cards at a minimum and up to more than 100 cards will be difficult to play, especially for anyone with dexterity issues. Further the deck created has no unique board to enhance the play of cribbage.

PLAY OF THE GAME AND BOARD

Figure 1:
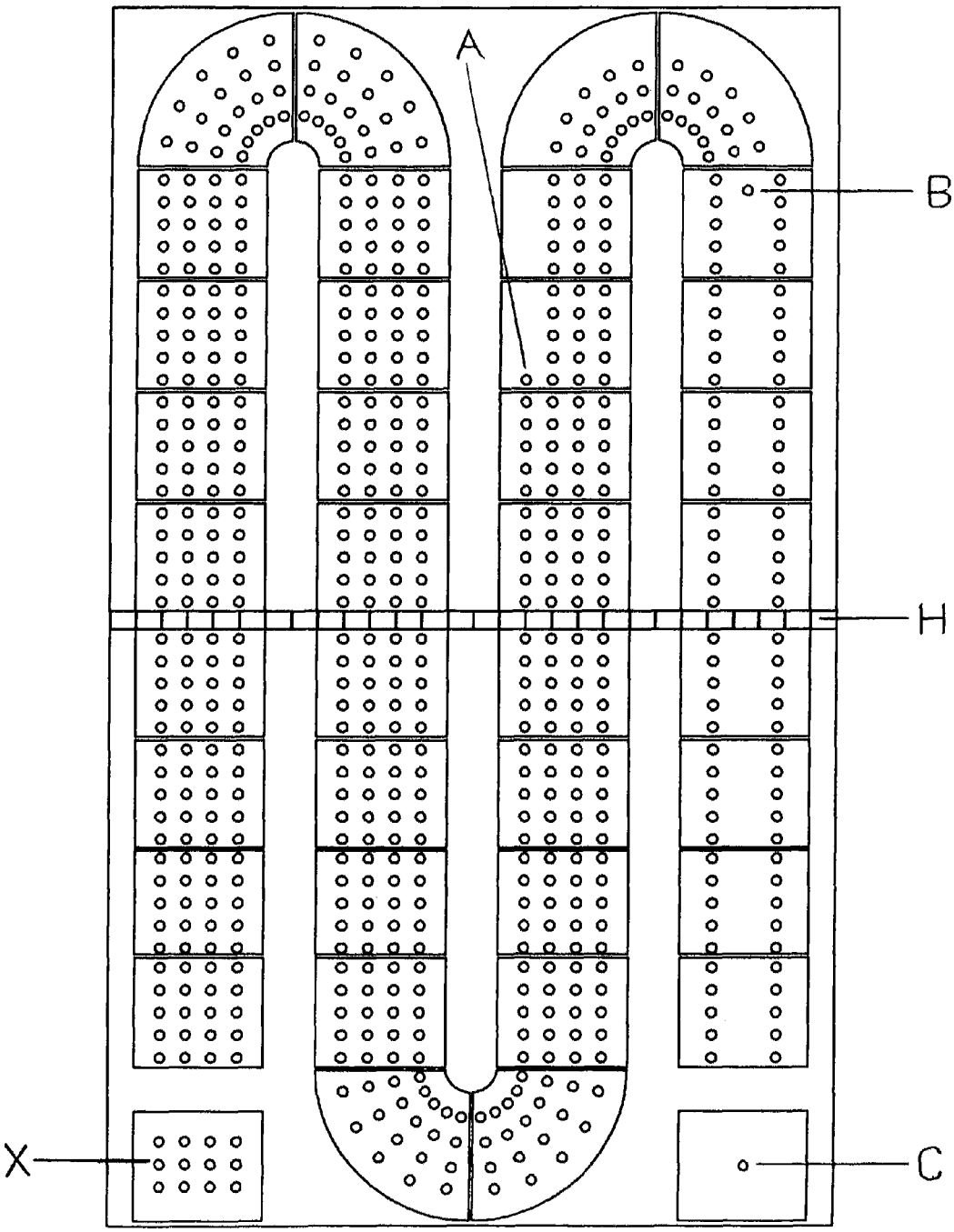
FIG. 1 is a top view of a first embodiment of a cribbage game pegging board.

This hybrid cribbage game preserves the integrity of standard cribbage while characteristics and additional rules of play are assigned to one or more special cards. This cribbage game follows cribbage rules for the order of cutting for deal, dealing and throwing cards, counting runs, counting pairs, counting fifteens and flushes. Special cards are added to a standard 52-card deck at levels chosen by the makers of the game and or by players. This makes the deck at least 53 cards when cutting for deal, with a means to structure the cards in an order to determine who cuts for deal.

In order to best play our game embodiments, a player should first understand standard cribbage rules. There are many ways to play cribbage using our embodiments of a deck with special cards and accompanying board embodiments. Below are two methods among many. For purpose of explanation we'll call special card (f) 'The Master™' card, special card (e) a 'Super Wild™', special card (d) a 'Wild Card', special card (c) a 'Special-Five™' card, special card (b) a 'Super Ace™', special card (a) the 'Zero Card™'. The special cards can be added at varying levels. With only one of The Master card in the deck a player can score five of a kind and a five-card flush in the hand or crib hand.

Our card games can be played on a standard cribbage board and played on our board embodiments made specifically for cribbage games. Because the games have higher hand totals and move faster than standard cribbage, we recommend playing further than the standard 121 points. However players may want to play to 121 so the games go quicker and players can play more games. For four individual players we recommend playing to 121 or 141, for three 141, and for two we recommend 181. We contemplate other lengths, and players can play varying lengths using our boards.

When cutting for deal, The Master card is the lowest, followed by the Zero-Card, Super-Ace, Super-Card, Wild Card, standard ace and so on. When cutting for deal, when a player cuts to The Master card they get 5 points, a Super-Wild 4 points, and a Super-Ace is 1 point; where in such cases the winner of the cut starts the game in the lead.

Every special card is of any and every suit for flush purposes. Thus if a player has 3 diamonds and a special card in their hand she will call it a diamond for an additional 4 flush points in a regular hand. If a matching suit card or special card is then cut, she will have a 5-point flush. As in standard cribbage, with our embodiments the crib hand must have all five suits matching to collect flush points. It is easier to attain flushes with special cards because they are any suit. Holding three Wild-Cards with any other card of any suit in a hand when a Super-Wild is cut scores a 5-point flush because it is at most one card with single suit denomination and all others are any. Each jack and special card played as a jack held in a hand gets a point for nobs when any special card is cut.

When someone plays a card for a 15 or 31 during pegging, playing the Zero-Card next scores 2 points for the 15 or 31. It can also be used during pegging and counting in runs of zero, ace, and two. The only card besides another Zero-Card that can pair a Zero-Card is The Master card as described later. No points are given for cutting to a Zero-Card.

When a Super-Ace is cut during play, the crib holder or dealer pegs 1 point. It pairs any ace for counting and pegging and can be played as 1 or 11 during pegging. For example, when the total is 20 the holder has the option to play it at 21 for no points or 31 for 2 pts. The holder can call 'go' even though they could play it as 1 point so long as the total to them is 21 points and over. The next round of play, the holder who called go can play it as a 1 or 11. It also scores as a high ace run of queen, king and Super-Ace.

The value of the Super-Ace is 1 and 11 during counting. Meaning it can be used two ways in the same hand during counting. It can be used as 1 and 11 with fours to total 15 points during counting and pegging play. Thus a player holding two queens, a king, and a four when a Super-Ace is cut, will have a double run for 8 points, three 15's counting the Super-Ace as 1 for 6 points and another 15 for 2 with the Super-Ace counted as 11 for a total of 16 points. With a flush, the points would be higher.

The Special-Five's value is five and cannot be changed. Special-Fives in play increase the chance of attaining a 45 point hand with five fives and a 5 point flush.

A Wild Card is any standard face card value the player chooses, but cannot take the value of a Zero-Card or Super-Ace. The holder must use the same value during both the pegging and counting portion of a hand. We recommend the player who physically cuts the deck, gets to call the face value of the cut wild card. This eliminates an unfair advantage of the crib holder to select a value favorable to both of their hands. The person holding the crib pegs 2 points when a wild card is cut.

The Super-Wild is a wild card that can be played as any standard card face value and can be played during pegging as one face value and counted as another. During pegging the holder can strategically specify the face value when playing it as a 10-point value to make pairs, 15's or runs. The holder of a Super-Wild as his last card must play it when the total before him is 21 or less, but can call go if the total is 22 or more. When the holder plays a Super-Wild as the first/last card played after the last go is called, he collects 4 points for last card. Thus when a player holding a Super-Wild says go and no other player has a card left, the opposing player takes 1 for last card. The Super-Wild holder is the last person holding a card and plays it from zero for 4 pts.

If play dictates laying a Super-Wild as the first card starting from zero during play, and the other player or players have cards, the next player to lay a card determines the combined or pair value and takes any peg points accordingly. When the Super-Wild is cut, the player who physically cut the deck gets 4 peg points and every player can use it as any standard card of any suit for their hand.

The Master card is like a Super-Wild where it can be played as a separate face value during pegging and counting. The Master card allows the extra option to play it after calling go. The Master can be played as a Super-Ace or Zero-Card during pegging and counting. When The Master and a Super-Ace are in one hand and The Master is counted as a Super-Ace, the two cards are 'two pairs' or 4 points, each special card being 1 and 11 in the same hand.

The Master automatically 'flushes' a hand. In the regular hand it gives 4 and for the crib, 5 flush points. It does not affect the cut card except when in the crib hand. Thus to attain the $5^{th}$ point, all the suits within the regular hand must match the upturned card. If the upturned cut card is a Wild Card yet the regular hand has a mix of suits plus The Master, the player does not get the $5^{th}$ point. For the crib hand The Master card flushes all cards including the upturned cut card for a total of 5. The Master in your crib is thus worth a minimum of 7 points for a pair and five card flush.

Play The Master as the very last card in the pegging round after starting the total from zero, for 5 peg points. If played as the first card from zero, the opposing player calls the value during pegging. That should never happen to a clever player because The Master can be played as a Zero-Card after a 31. The person who physically cuts the deck gets 5 points when The Master is cut during play and it is any value and suit to all players.

One of the most exciting and rare plays happens when The Master is played immediately after the Super-Wild. When it happens the point total is automatically doubled. Thus, in a circumstance where play starts from zero and three threes are played, then the Super Card is played to make four threes in a row for 12 peg points for the pairs. Playing The Master card next will give you five of a kind for 20 pegs points, plus a total of 15 for 2 more peg points, then double it for 44 peg points!

An alternate game with this embodiment is "See-one-play-one". When a player throws down a card, the opposing player must play a card in their hand as same card for a pair if they can. Any matching and special cards in the hand must be played as the card until the player runs out of cards, or must play their cards at another face value. So, a player holding several of one card, say a three, can force the opposing player to continue to play any threes or special cards as a three during peg play. The high totals can arise to more than eight of the same card being played in succession for 56 peg points and more. After pegging, one method allows you to count or tally the cards as you would have and another says you must count them at the played value during pegging. It's players' choice, determined before the start of a game.

DETAILED DESCRIPTION OF THE INVENTION

FIG. 1 is a top view of a first embodiment of a cribbage game pegging board, simulated and or made from a suitable material, with four contiguous pegging lanes and three differing lengths of pegging lanes. This embodiment accommodates our cribbage games, standard cribbage and other cribbage games for purpose of tallying points. This figure represents an embodiment we presently contemplate, but other lengths of peg lanes, embodiments with more than four lanes, other shapes and sizes of boards and ornamental features can be used.

The first embodiment of the cribbage game pegging board in FIG. 1 shows a start position X to hold pegs for up to four lanes of play.

The first embodiment of the cribbage game pegging board in FIG. 1 shows a first finish hole A at 121 points, the length of play for a standard game of cribbage. This is the placement of a finish hole we contemplate for this embodiment. We also contemplate having the finish hole outside the lanes or in other places on the board and at other lengths. Further we have contemplated splitting the board and other design embodiments to the flow of the board. The row of peg holes immediately before this finish hole is an end line for four individual players and optional end line for three or two individual players and teams of two players. It is a transition line on the board where three or fewer individual players or teams of two players can continue on with play to a further length on the board.

The first embodiment of the cribbage game pegging board in FIG. 1 shows a second finish hole B at a place further down the first embodiment than finish hole B and positioned at shorter length than finish hole C. We also contemplate having the finish hole outside the lanes or in other places on the board and at other lengths. The row of peg holes immediately before this finish hole is an end line for three individual players and an optional end line for two individual players and teams of two players.

The first embodiment of the cribbage game pegging board in FIG. 1 shows a third finish hole C further on the board than finish holes A and B. We also contemplate having the finish hole outside the lanes, other places on the board, at other lengths and having more than three finish holes. The two peg holes immediately before this finish hole are an end line further on the board than the previous end-lines. The end line is for two individual players and teams with two players. We contemplate other lengths of lanes.

The first embodiment of the cribbage game pegging board in FIG. 1 shows a hinge allowing it to fold in half. We can also make the boards solid, multi-hinged, of varying materials, and other designs we contemplate.

Figure 2:
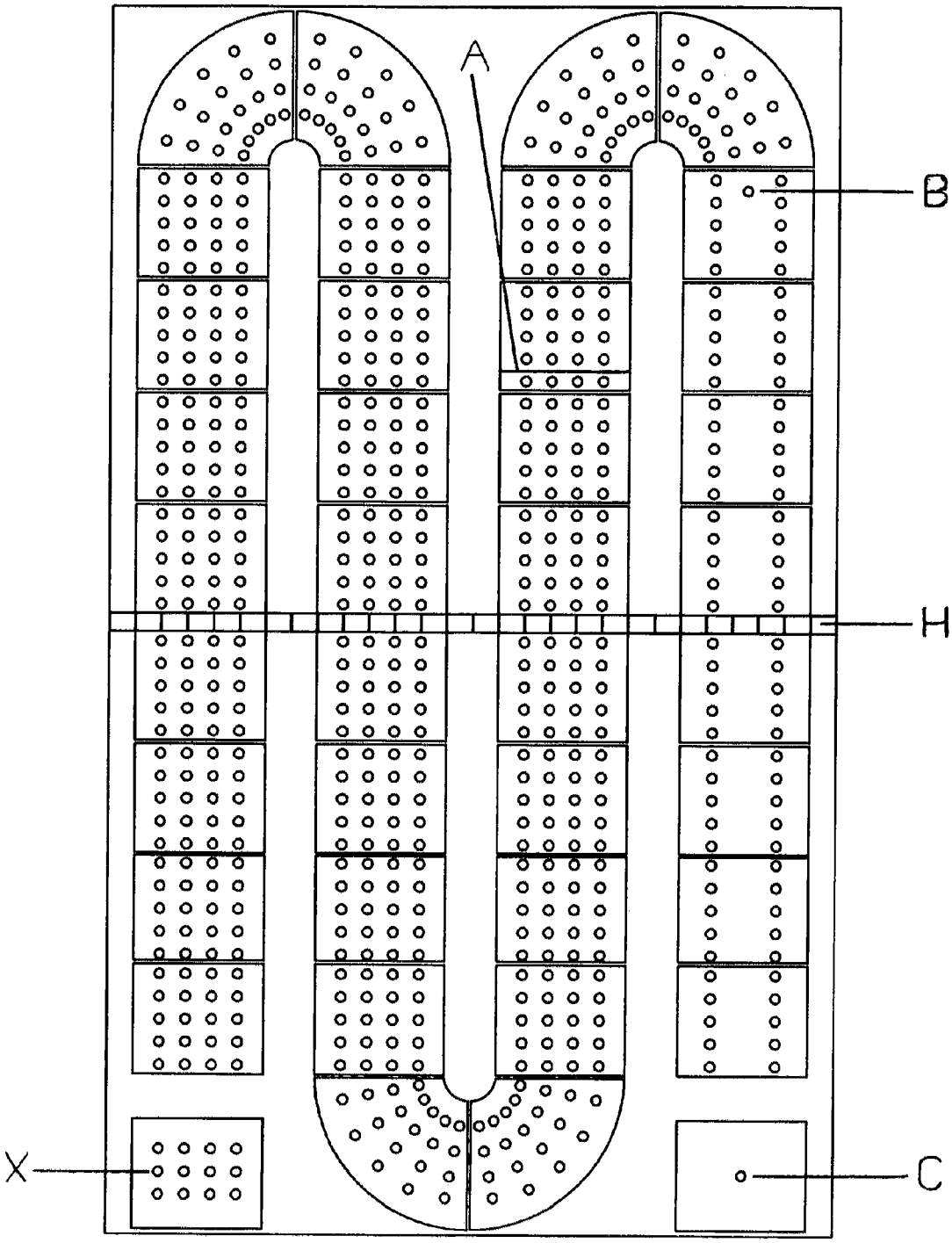
FIG. 2 is a top view of a second embodiment of a cribbage game pegging board.

FIG. 2 is a top view of a second embodiment of a cribbage game pegging board, simulated and or made from a suitable material, with four contiguous pegging lanes and two differing lengths of peg lanes. The embodiment allows the user to play our enhanced game of cribbage, standard cribbage and other cribbage pegging games.

The second embodiment of the cribbage game pegging board in FIG. 2 shows a start position X to hold pegs for up to four lanes of play.

The second embodiment of the cribbage game pegging board in FIG. 2 shows a line A having 4 adjacent peg holes, each in separate pegging lanes, any of which can serve as a finish hole for standard cribbage at 121 points for up to four individual players and teams of players. It is a demarcation line on the board for this embodiment boxing in where a finish hole would be and is on a standard length cribbage board. We contemplate other means to indicate the end line and finish hole or holes such as colorations on the board, arrows, grooves, separation from the next peg holes on the board, an added finish hole outside the lanes of play and other means. We contemplate computer and other simulated means including playing a game on a visual device that gives players options of more than one length of play. Once the length of play is chosen the other lengths can disappear from view during play, no longer visually showing the other lengths.

The second embodiment of the cribbage game pegging board in FIG. 2 shows a finish hole B for three and four individual players. It is an optional finish hole for two or fewer individual players and teams of two players. It is further on the board than finish hole A for standard cribbage and positioned at a shorter length than finish hole C. It is an optional end line or continuation line for two or fewer individual players and teams of two players. We contemplate other lengths of play besides that represented in B.

The second embodiment of the cribbage game pegging board in FIG. 2 shows a third finish hole C for two individual players and teams with two players. In this embodiment it is further on the board than finish holes A and B. We also contemplate having this finish hole between the lanes or in other places on the board, at other lengths and in conjunction with other finish holes for other lengths of play.

The second embodiment of the cribbage game pegging board in FIG. 2 shows a hinge H on the board that allows folding.

Figure 3:
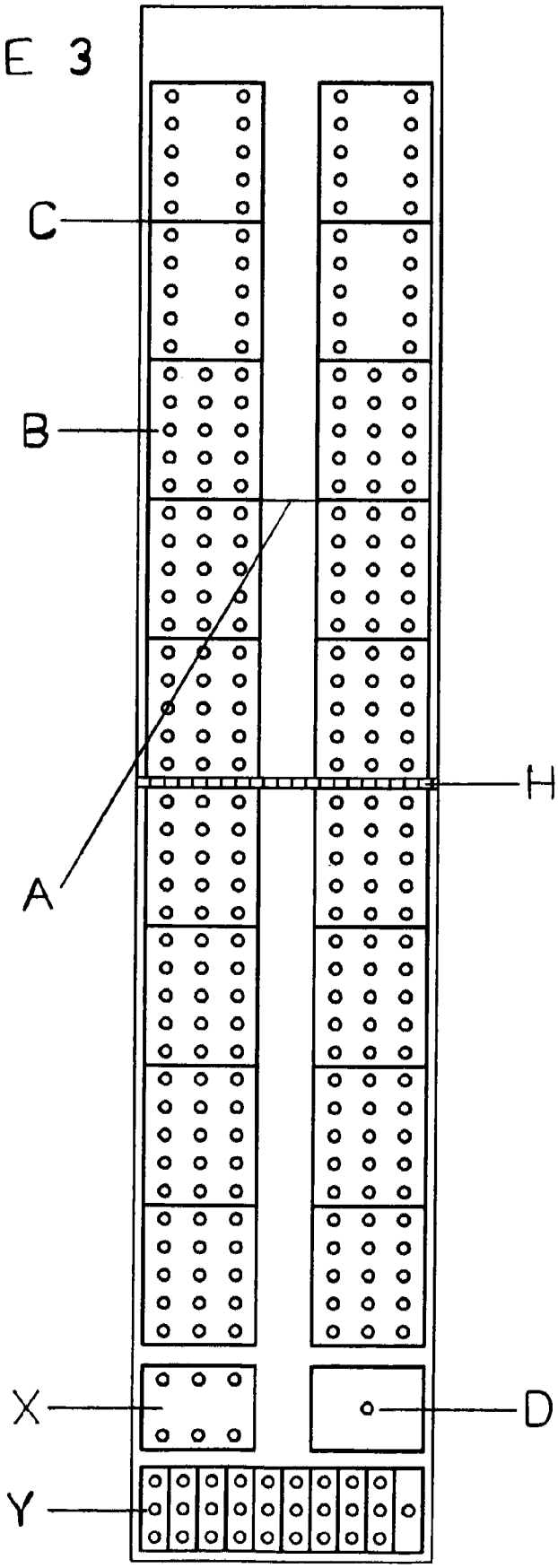
FIG. 3 is a top view of a third embodiment of a cribbage game pegging board.

FIG. 3 shows a top view of a third embodiment of a cribbage board which is simulated and or made from a suitable material, with three parallel pegging lanes and two differing lane lengths on each side of the board. Each section of playing peg lanes have a corresponding set of lanes and peg holes on the opposite side. The board allows the user to play our enhanced games of cribbage, standard cribbage and other cribbage style games.

The third embodiment of the cribbage game pegging board in FIG. 3 shows a start position X for the pegs.

The third embodiment of the cribbage game pegging board in FIG. 3 shows 3 peg lanes Y where players can tally the overall number of games they win.

The third embodiment of the cribbage game pegging board in FIG. 3 shows a demarcation line A on the cribbage board indicating where the lanes of a standard cribbage board end. For players choosing to play standard cribbage it is the indicator to change directions and go down the other side of the board. For standard cribbage, players go up and down twice. This embodiment shows three lanes at the start. We contemplate boards, real and simulated with more than three pegging lanes.

The third embodiment of the cribbage game pegging board in FIG. 3 shows three pegging lanes B that go five peg holes beyond standard cribbage length and end. Three individual players using this embodiment to play beyond standard cribbage length change directions at the end of the lane to go down the other side at the equivalent point. Two individual players and teams of two players can choose this length to change directions on the board as well. Players can go up and down the board passing along this section once or more than once and end in the finish hole. For the current embodiment of cards and board we recommend going up and down twice. We also contemplate making this section shorter, longer, with fewer or more lanes and in other places on the board. Visually simulated boards can automatically show or not show varying lengths of play based upon player and manufacturer preferences.

The third embodiment of the cribbage game pegging board in FIG. 3 shows a section of two pegging lanes C extending ten peg holes further than section B where the three lanes end. Two players and teams of two players each can use this length of pegging lanes to play cribbage games longer than standard cribbage. With this embodiment, the two long lanes on each side of the board are 45 peg holes in total length. This length is equivalent to the 45-point hand possible in the card game embodiment. Each length has within it a standard cribbage length and other possible lengths less than 45 but greater than 30 of standard cribbage. The pegging lanes on each side of the embodiment have a matching equivalent on the other side. Players choosing to play the longest length on this embodiment will change direction on the board. We also contemplate other length lanes having related derivatives of length, proportions of length and other lengths we contemplate for use of play.

The third embodiment of the cribbage game pegging board in FIG. 3 shows the finish hole D for every lane and length of play.

The third embodiment of the cribbage game pegging board in FIG. 3 shows an optional hinge H for folding this embodiment.

Figure 4:
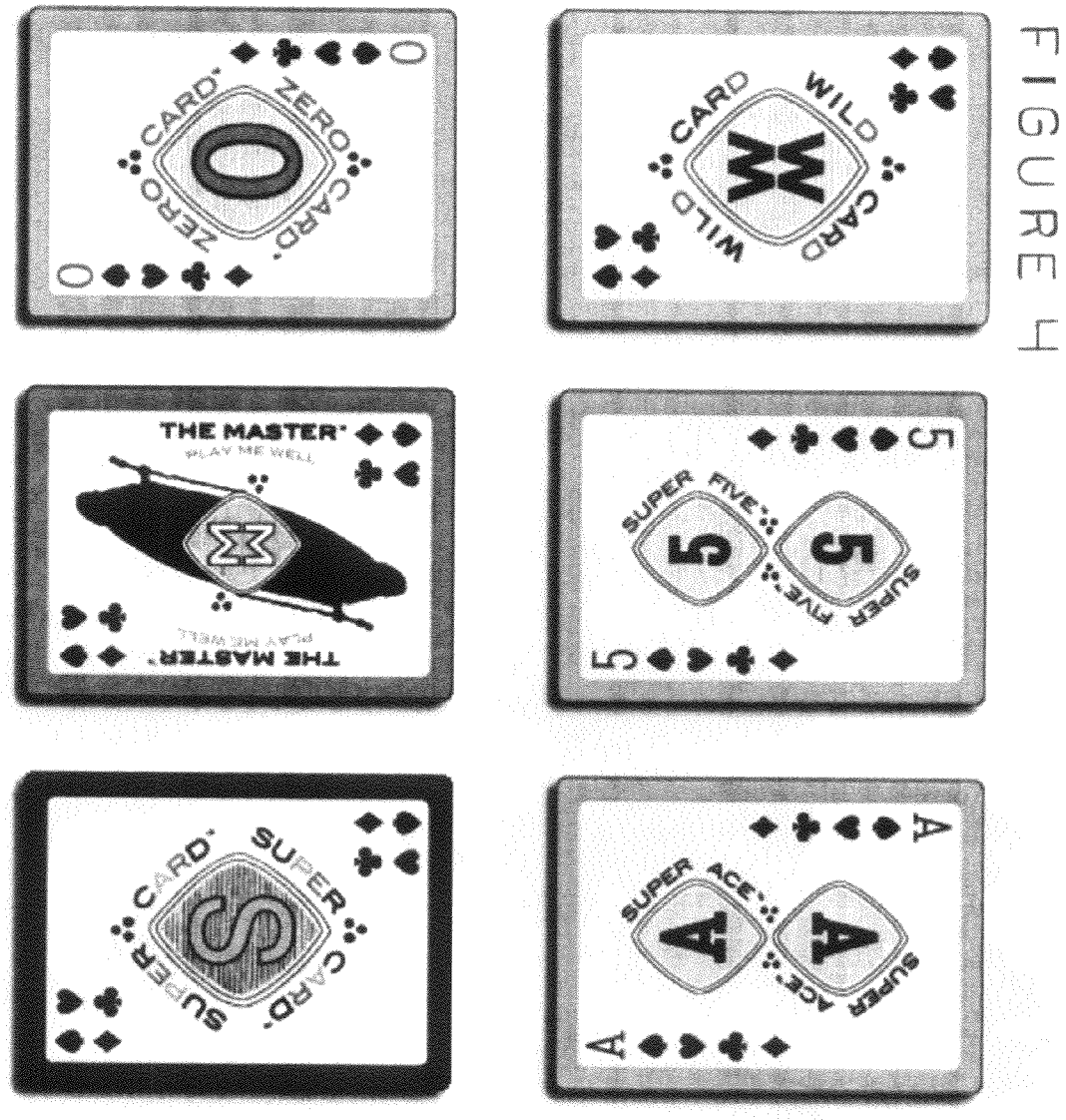
FIG. 4 is a top view of special cards.

FIG. 4 shows an embodiment of special cards in the following order from upper left to right of row one: special card (d), special card (c), and special card (b). The bottom row from right to left shows an embodiment of special card (a), special card (f) and special card (e). One or more of these cards can be used in any combination. In order to have five of a kind and a five-card flush with only one special card added to a standard 52-card deck, The Master must be in the deck and within the crib hand. This hand would be with three cards with the same face value and The Master card in the hand. A cut card matching the face value of the three cards in the crib would make five of a kind and the Master flushes all five cards within the crib hand.

Each card embodiment has a one face value and one representation of each suit on its face. We also contemplate special cards with no suit indicia on their face yet having properties of representing all suits for flush purposes and other plays and characteristics for the special cards.

ADVANTAGES

From the description above a number of advantages of the embodiments of our card game and pegging board embodiments become evident:

(a) The new game may interest new players with no experience to the game thus helping manufactures and sellers to move product into the marketplace, meanwhile providing users a fun and inexpensive way to spend their time.

(b) The cribbage game uses a deck of 52 standard cards and can be used to play any standard card game, standard cribbage game, as well as the other games we describe. This will allow a player to play standard cribbage or to teach standard cribbage to a new player as a prelude to learning the new, more complicated and fast paced games with added special cards described here.

(c) The game increases the pace and point totals over standard cribbage, making the game more interesting, thought provoking and fun. It creates a new language or nomenclature when playing. Hands with no special cards can be called 'natural' hands.

(d) The cribbage game can be played on a standard board at standard length or by extending the length of play on that board. This allows players who already own a board to use their existing board during play. It can also be played on our embodiments for players who wish to have a dedicated board, which accommodate multiple and longer pegging lengths.

(e) Addition of a Super-Ace in cribbage creates new high straight and card counting combinations that score additional points.

(f) Addition of special cards to a standard 52-card deck enhances the strategy of pegging, counting and throwing to the crib hand compared to standard cribbage. Players who have mastered cribbage will appreciate new challenges to their skill and abilities.

(g) The board embodiments are aesthetically pleasing, and are easy to use and understand.

(h) Additional special cards can be optionally added to a deck thereby allow players to choose the amount they wish to use to help establish the pace and complexity of the game.

We claim:

1. A method of playing a cribbage based card game via an electronic media, the method comprising:

providing a visual device display, an input device, and a processor to perform the steps of:

adding one or more differently denominated special cards to a standard 52-card deck;

assigning additional rules of play and characteristics including a value relationship for each special card in relation to established rules of cribbage and any other special cards, and wherein cutting to a card other than a standard jack scores a predetermined number of pegging points during play and when cutting for deal before play has started;

playing the cards for pegging purposes according to standard cribbage rules and the additional rules of play and characteristics; and counting a single hand under the assigned additional rules of play and characteristics, the single hand having five cards of the same face value with all five of said cards counting as the same suit for a five card flush to increase points for a player.

2. The method of playing the card game of claim 1 wherein the step of counting the five cards allows the player to achieve a 45 point hand by counting the five cards as a combination of pairs and fifteens that totals 40 points, and all cards counted in said 45 point hand are counted as the same suit and add a 5 point flush, wherein said 45 hand comprises four fives and a cut card valued five, wherein said fives can be denominated as fives on their face, can be one or more special cards counted and used as fives, or can be any combination of fives and special cards whereby the cards comprising said 45 hand having a flush with the denomination of a suit in common on the face of all cards, and having a flush equivalent for 5 points when one or more of said special cards in said hand has no suit representation yet represents one or all suits for purpose of play, and when a special card in the hand can be played to give the other fives, regardless of their suit, the equivalent of a flush for purpose of counting, wherein said game is played on a board, a computer, and any other means to tally points and facilitate said game's play.

3. The method of playing the game of claim 1 wherein the step of counting the five cards allows the player to achieve a hand score totaling 19 points wherein the combined points of runs, pairs and 15's of the cards comprising said 19 point hand is 14 points and said cards also have the means to collect 5 points for a five card flush.

4. The method of playing the cribbage game of claim 1 wherein the one or more differently denominated special cards includes one or more of special card (a), special card (b), special card (c), special card (d), special card (e), and special card (f), are added to the standard deck, and wherein each of said special card (a)-(f) additional rules of play and characteristics are added alone or in any combination with other special cards (a)-(f) additional rules of play and characteristics.

5. The method of playing the cribbage game of claim 1 providing a means for more than eight cards to be played in a row during pegging wherein each card can be played as the same face value for scoring purposes.

6. The method of playing the cribbage game of claim 1 wherein for tallying flush points said one or more special cards represent all suits with a heart, club, spade and diamond on the face, or have no suit representations on the face.

7. A method of playing a cribbage game with a standard 52 card deck and additionally one or more special cards on electronic media and requiring, the method comprising:

providing a visual device display, an input device, and a processor to perform the steps of:

adding a special card (a) to said standard deck where special card (a) has a face value of zero;

assigning said special card (a) additional rules of play and characteristics that allows said special card to earn points counted in a run of zero, ace and two, said card scores 2 points for the player who lays said card during pegging directly after 2 points are scored for a 15 or 31; and playing said special card (a) for pegging and counting purposes according to standard cribbage rules and the additional rules of play and characteristics to increase points for the player.

8. The cribbage game of claim 7 further comprising:

adding one or more special card (b) to said deck having the face value of an ace, assigning special card (b) additional rules of play and characteristics that allows said special card (b) to earn a value of 1 or 11 during pegging and 1 and 11 value when counting and can increase points in a hand whereby said special card (b) is played with points counted as a high-ace in a run of queen, king and ace, said card can be played as a regular ace for low runs and pairs with standard cards and in any cribbage point scoring combination with other special cards.

9. The method of playing the cribbage game of claim 8 wherein when special card (b) is counted with an identical special card (b) in the same hand, or when special card (b) is counted with a special card (f) that was played for pegging purposes as the same value as said special card (b), said special card (b) will give the player a 4 point pair counting both the high and low value of 11 and 1 and collecting 2 points for each high and low value.

10. The method of playing the cribbage game of claim 8 wherein said special card (b) gives a predetermined number of peg points to the player when said card is cut for deal and play.

11. The method of playing the cribbage game of claim 7 further comprising:

adding one or more special card (c) to said deck where said special card (c) has a face value of five; and assigning special card (c) additional rules of play and characteristics that allows said special card (c) to earn points counting and playing, said special card (c) pairs any five, is used as a five for totaling 15 and in runs.

12. The method of playing the cribbage game of claim 7 further comprising:

adding one or more special card (d) to said deck; and assigning special card (d) additional rules of play and characteristics that allows said special card (d) to be played and counted as the same face value chosen by the player holding said card in their hand, wherein said face value is that of any standard card and can increase points in a hand.

13. The method of playing the cribbage game of claim 12 wherein when the special card (d) is cut during play, the player to the right of the dealer calls the face value of said special card (d) and all players use the called face value when counting their hand, said special card (d) gives a predetermined number of peg points, one or greater to the player holding the crib when said card is cut during play.

14. The method of playing the cribbage game of claim 7 further comprising:

adding one or more special card (e) to said deck; and assigning special card (e) additional rules of play and characteristics that allows said special card (e) to be played as one face value during pegging and as another during counting and said special card (e) can be played and counted at any standard face value.

15. The method of playing the cribbage game of claim 14 wherein when the special card (e) is cut during play, a face value of said special card (e) is chosen and counted by each player individually as any standard card in the deck as they choose for their hand and at any standard card value a holder of the crib should so choose for counting a crib for that hand, and wherein said special card gives a predetermined number of peg points to the player when cut for deal and during play.

16. The method of playing the cribbage game of claim 7 further comprising:

adding one or more special card (f) added to said deck; and assigning special card (f) additional rules of play and characteristics that allows said special card (f) to create a flush in a hand of the player who holds said special card (f) regardless of the suit denominations and combination of the cards within said hand thereby giving a crib hand in which it is held a five card flush, and can increase points in said hand whereby said special card (f) flushes four cards in a standard hand and can be played as one face value during pegging and counted at another face value, said special card allowing the holder to play said special card (f) as any face value and characteristic of any card in the deck including additional special cards, and, said special card (f) can be played after calling go during pegging and said special card (f) scores double peg points when played during pegging directly after a special card (e).

17. The method of playing the cribbage game of claim 16 wherein when the special card (f) is cut during play, a face value of said special card (f) is chosen and counted by each player individually as any standard or special card in the deck as they choose for their hand and at any standard or special card value for counting a crib for that hand, and wherein said special card (f) gives a predetermined number of peg points to the player when cut for deal and during play.

18. The method of playing the cribbage game of claim 7 wherein one or more of special card (b), special card (c), special card (d), special card (e), and special card (f), are added to the standard deck, and wherein each of said special card (b)-(f) additional rules of play and characteristics are added alone or in any combination with other special cards (b)-(f) additional rules of play and characteristics.

19. The method of playing the cribbage game of claim 7 where cutting to a card other than a standard jack scores a predetermined number of pegging points during play and when cutting for deal before play has started.

20. The method of playing the cribbage game of claim 7 providing a means for more than eight cards to be played in a row during pegging wherein each card can be played as the same face value for scoring purposes.

21. The method of playing the cribbage game of claim 7 wherein for tallying flush points said special card (a) represents all suits with a heart, club, spade and diamond on the face or has no suit representations on the face.

22. A method of playing a cribbage based card game via an electronic media and having at least two players, the method comprising:

providing a visual device display, an input device, and a processor to perform the steps of:

adding one or more differently denominated special cards to a standard 52-card deck;

assigning additional rules of play and characteristics including a value relationship for each special card in relation to established rules of cribbage and any other special cards, and wherein;

playing the cards for pegging purposes according to standard cribbage rules and the additional rules of play and characteristics; and counting a single hand under the assigned additional rules of play and characteristics, the single hand having five cards of the same face value with all five of said cards counting as the same suit for a five card flush to increase points for a player, wherein the five cards allows a player to achieve a hand score totaling 19 points and wherein the combined points of runs, pairs and 15's of the cards comprising said 19 point hand is 14 points and said cards also have the means to collect 5 points for a five card flush.

* * * * *